US008006979B1

(12) United States Patent
Lamm

(10) Patent No.: US 8,006,979 B1
(45) Date of Patent: Aug. 30, 2011

(54) GAME FOR SCULPTING OBJECTS AND METHOD OF PLAYING SAME

(76) Inventor: Connie L. Lamm, Sedalia, MO (US)

( * ) Notice: Subject to any disclaimer, the term of this patent is extended or adjusted under 35 U.S.C. 154(b) by 0 days.

(21) Appl. No.: 12/427,477

(22) Filed: Apr. 21, 2009

Related U.S. Application Data

(60) Provisional application No. 61/046,702, filed on Apr. 21, 2008.

(51) Int. Cl.
*A63F 3/00* (2006.01)

(52) U.S. Cl. ..... 273/276; 273/440

(58) Field of Classification Search ..... 273/276, 273/440
See application file for complete search history.

(56) References Cited

U.S. PATENT DOCUMENTS

| | | | | |
|---|---|---|---|---|
| 5,752,700 | A * | 5/1998 | Delzotti | 273/243 |
| 5,918,882 | A * | 7/1999 | Truong | 273/249 |
| 6,279,909 | B1 * | 8/2001 | Alexander et al. | 273/249 |
| 6,669,486 | B2 | 12/2003 | Frankenbery et al. | |
| 6,893,264 | B2 * | 5/2005 | Reed | 434/128 |
| 2003/0124500 | A1 * | 7/2003 | Frankenberry et al. | 434/311 |
| 2004/0183252 | A1 * | 9/2004 | Robinson | 273/243 |
| 2006/0108739 | A1 * | 5/2006 | Lutz | 273/292 |
| 2006/0197285 | A1 * | 9/2006 | McNeill | 273/292 |
| 2006/0220316 | A1 * | 10/2006 | Clayton | 273/248 |
| 2007/0013128 | A1 | 1/2007 | Pastor | |

FOREIGN PATENT DOCUMENTS

GB 2262454 A * 6/1993

OTHER PUBLICATIONS

"Hulk Smash! Game". Entertainment Earth. Dec. 29, 2009 <http://www.entertainmentearth.com/prodinfo.asp?number=HG40525>.

* cited by examiner

*Primary Examiner* — Vishu K. Mendiratta
(74) *Attorney, Agent, or Firm* — Hovey Williams LLP

(57) ABSTRACT

A multi-player game for sculpting a designated object by players of the game and judging said designated object by a judge, wherein the players earn points for each sculpted object chosen by the judge as most representing the designated object. The game broadly comprises a judge's board, a plurality of player's boards, sculpting dough, a plurality of object cards, a smasher, an eye mask, a timer, a plurality of points indicators, and a game box for storing the above-listed items. A method of performing the game broadly comprises the steps of (a) selecting a judge from the plurality of players for a round of play of the game; (b) selecting an object to be sculpted; (c) preventing the selected judge from visually seeing the sculpting of the objects; (d) sculpting the selected object; (e) presenting the sculpted objects to the judge; and (f) selecting a winning sculpted object.

3 Claims, 2 Drawing Sheets

GAME FOR SCULPTING OBJECTS AND METHOD OF PLAYING SAME

RELATED APPLICATION

Figure 1:
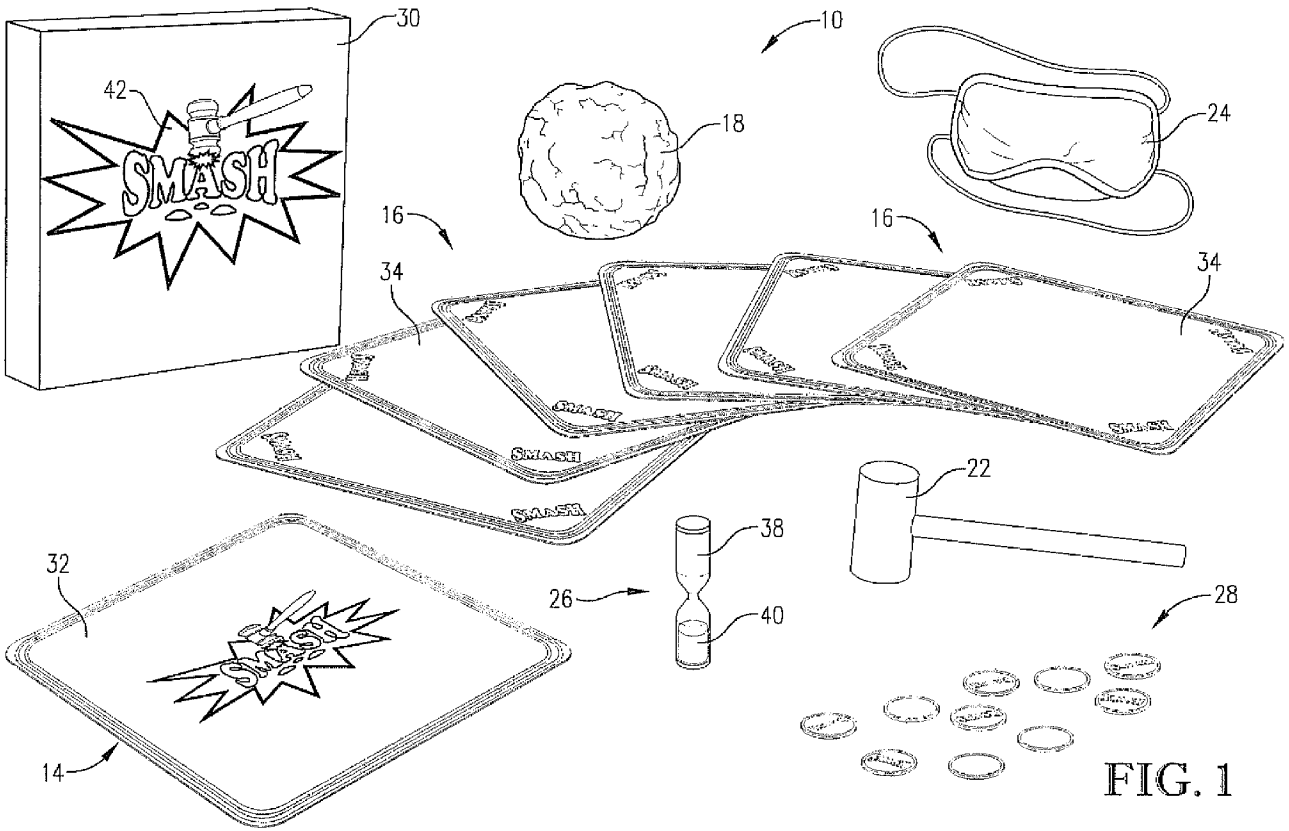

This non-provisional patent application claims priority benefit, with regard to all common subject matter, of earlier-filed U.S. Provisional Patent Application No. 61/046,702, filed Apr. 21, 2008, and entitled "GAME FOR SCULPTING OBJECTS." The identified earlier-filed provisional application is hereby incorporated by reference in its entirety into the present application.

FIELD

Embodiments of the present invention relate to games and methods of playing games. More particularly, embodiments of the present invention relate to a multi-player game providing for sculpting of a designated object during each round of play by players of the game and judging said designated object by a judge, wherein the players earn points for each sculpted object chosen by the judge as most representing the designated object for the particular round of play.

BACKGROUND AND SUMMARY

Multi-player games commonly involve use of playing cards, trivia, or word games. Such multi-player games can be fun and entertaining for a limited subset of players. However, use of the games for a variety of players playing at the same time, including players of all ages and backgrounds, is not always possible. For example, trivia games are not conducive for players with ages ranging from a small child to an adult, as the child usually does not have the same knowledge as the adult. Such is the same for games involving a standard deck of playing cards or word games, as usually such games are too advanced for children.

Additionally, common multi-player games are not always conducive to a variety of players from different backgrounds playing the game. For example, in a trivia game, some players may not be knowledgeable regarding the same fields or genres of trivia than other players, even if all the players are adults.

Further, many multi-player games have difficult rules that are time intensive to understand and explain to new players. For example, card games are often complicated and involve numerous rules that must be learned and explained, often throughout the game.

Finally, none of the above-discussed multi-player games engage more than the players' mental abilities. In particular, the above-discussed games do not allow for artistic expression and use of the players' hands.

Accordingly, there is a need for a game and a method of playing same that allows for players of many ages to play the game together. Additionally, there is a need for a game that allows players of various backgrounds to play the game together. Furthermore, there is a need for a game with rules and objectives that are readily and easily explained and understood and that engages the players' artistic abilities and allows for artistic expression.

Embodiments of the present invention solve the above-described problems and insufficiencies and provide a distinct advance in the art of games and methods of playing games. In more detail, embodiments of the present invention provide a game and a method of playing same that allows players to sculpt a designated object from a moldable dough or clay. A selected judge for each round of play of the game then chooses the sculpted object that best represents the designated object. The winning sculpted object is chosen based on the preferences of the judge, and such preferences may include factors or criteria that are both subjective and objective.

The game of embodiments of the present invention broadly comprises a judge's board, a plurality of player's boards, sculpting dough, a plurality of object cards, a smasher, an eye mask, a timer, a plurality of points indicators, and a game box for storing the above-listed items.

The method of playing the game of embodiments of the present invention broadly comprises the steps of: (a) setting a playing limit for each game, wherein the playing limit is either an amount of time the game is to be played or a number of rounds of play for each game; (b) selecting a judge for a round of play; (c) selecting an object to be sculpted, wherein said selection is performed by the judge for the round of play; (d) preventing the judge from visually viewing the sculpting of the objects by covering the selected judge's eyes with the eye mask; (e) beginning a sculpting session for the round of play by starting the timer to time the sculpting session; (f) sculpting the selected object, wherein the sculpting is performed by all players of the game except for the selected judge for the round of play; (g) at the completion of the sculpting session, presenting the sculpted objects to the judge on the judge's board; (h) selecting a winning sculpted object, wherein the selection is performed by the judge based on a plurality of objective and subjective factors; (i) smashing or otherwise deforming the sculpted objects except for the winning sculpted object, wherein the smashing is performed by the judge using the smasher; and (j) awarding the player who sculpted the winning sculpted object one of the points indicators.

The game and method of playing same of embodiments of the present invention thus provide a game that can be played by the plurality of players, regardless of the players' ages, education, knowledge, or background. The game encourages acceptance, skills, and contributions of players of all ages. Further, the game develops the ability in the players to see objects as others (i.e., the judge) may see them. Moreover, the game enhances communications skills and illustrates to the players how other players and persons perceive objects from diverse perspectives.

BRIEF DESCRIPTION OF THE DRAWING FIGURES

Figure 2:
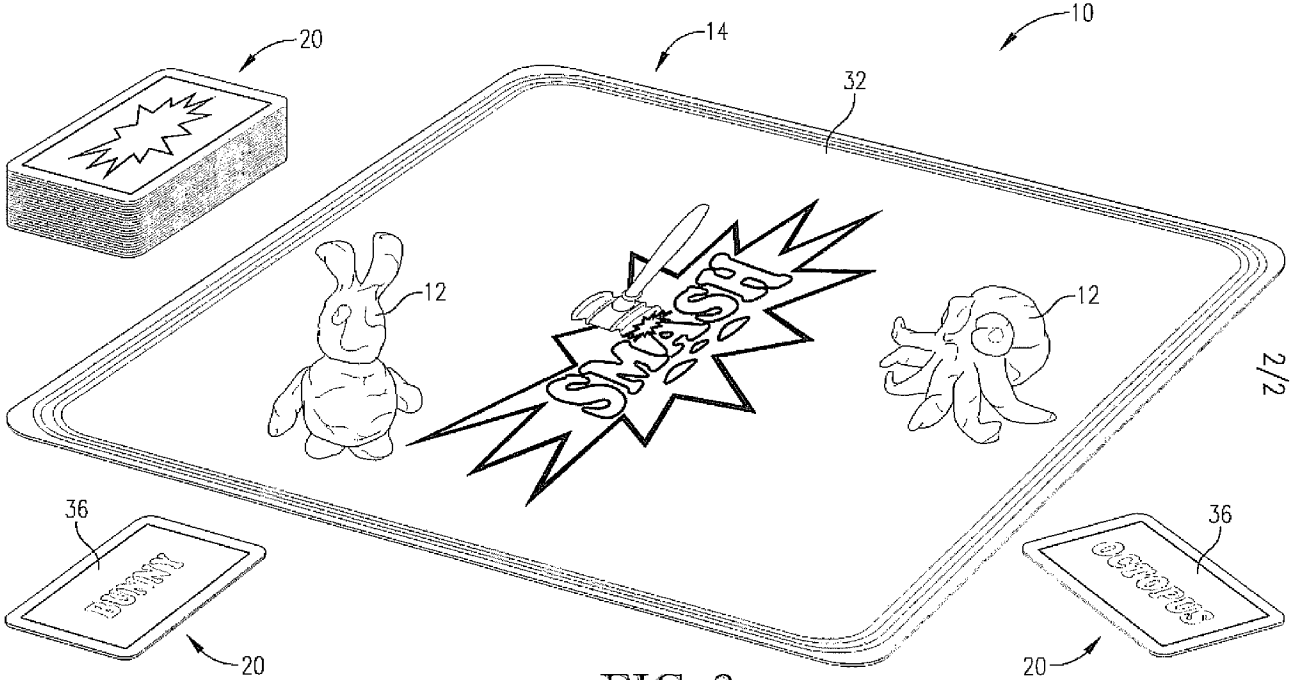

Embodiments of the present invention are described in detail below with reference to the attached drawing figures, wherein:

FIG. 1 is a collective, perspective view of components of a game for sculpting objects of embodiments of the present invention; and FIG. 2 is a collective, perspective view of a judge's board of the game, a plurality of object cards, and a plurality of sculpted objects presented on the judge's board.

The drawing figures do not limit the present invention to the specific embodiments disclosed and described herein. The drawings are not necessarily to scale, emphasis instead being placed upon clearly illustrating the principles of the invention.

DETAILED DESCRIPTION

Turning now to the drawing figures, and particularly FIGS. 1-2, a game 10 for sculpting objects 12 by a plurality of players and a method of playing same is illustrated. The game 10 broadly comprises a judge's board 14, a plurality of player's boards 16, sculpting dough 18, a plurality of object cards 20, a smasher 22, an eye mask 24, a timer 26, a plurality of points indicators 28, and a game box 30 for storing the above-listed items.

The judge's board 14 and the plurality of player's boards 16 are preferably substantially rigid and configured to fit within the game box 30. In embodiments of the present invention, the boards 14,16 are made of cardboard or rigid plastic. Each board 14,16 presents a respective face 32,34 that is preferably coated with or formed of an anti-stick material that can easily be cleaned and is resistive to the sculpting dough 18 sticking to the face 32,34. In embodiments of the present invention, the material of the face 32,34 of each board 14,16 is also at least partially water repellant, such that the face 32,34 can withstand being wiped with a damp cloth for cleaning.

The faces 32,34 of the judge's board 14 and the plurality of player's boards 16 are distinguished with different colors and markings. Referring to FIG. 1, the face 32 of the judge's board 14 preferably has a first dominant color, and the face 34 of the plurality of player's boards 16 has a second dominant color, wherein the first and second colors are different. For example, the face 32 of the judge's board 14 is preferably blue, and the face 34 of the plurality of player's boards 16 is preferably red. The faces 32,34 of the boards 14,16 also include one or more secondary colors and other distinguishing markings so that a player can visually differentiate between the judge's board 14 and the plurality of player's boards 16. For example, the face 32 of the judge's board 14 is labeled with a name of the game 10, such as "SMASH™," positioned in a general middle of the board 14, whereas the player's boards 16 are labeled with "SMASH™" at corners of the boards 16. Alternatively, the judge's board 14 could be labeled "Judge's Board," and the player's board 16 could be labeled "Player's Board." Although each of the player's boards 16 preferably includes the same distinguishing markings on the respective faces 34, in alternative embodiments of the present invention, each player's boards 16 may have different distinguishing markings or may be of different colors.

The sculpting dough 18 is preferably a moldable clay or putty that can be molded into a shape and hold such shape for at least a period of thirty minutes to one hour under normal room temperature, as illustrated in FIGS. 1-2. The sculpting dough 18 is therefore soft and flexible. The sculpting dough 18 is preferably a neutral color, such as beige or tan, although the dough 18 could be a bolder color, such as red, blue, or yellow. Alternatively, dough 18 of multiple different colors could be provided with the game 10, such that each player would have a different-colored dough 18. Additionally, the dominant color of each player's board 16 could coincide with the color of the player's sculpting dough 18. The dough 18 may be stored in a resealable plastic bag (not shown) to prevent the dough 18 from hardening. Alternatively, the dough 18 could be stored in a rigid, airtight container (not shown).

Referring to FIG. 2, each of the plurality of object cards 20 has a face 36 labeled with an object to be sculpted using the sculpting dough 18. Exemplary objects include a dog, a bunny, an octopus, a telephone, a bicycle, luggage, and a guitar. As described in more detail below, an object card 20 is drawn, and then the players use the sculpting dough 18 to sculpt the player's representation of the object. The objects illustrated in FIG. 2 and described herein are not intended to limit the objects that may be sculpted as a step of the method of playing the game 10 of embodiments of the present invention. In alternative embodiments of the present invention, the game 10 may be played without use of the object cards 20, and the players decide an object to be sculpted without reference to the object cards 20.

The smasher 22 is illustrated in FIG. 1 and is generally shaped like a gavel or mallet. However, the smasher 22 could be any shape suitable for smashing the sculpted object 12. As described in more detail below, one of the players who is a judge for the round of play will use the smasher 22 to smash or otherwise deform the sculpted object 12 from its sculpted shape. Preferably, the smasher 22 is made of a material that will not allow the sculpting dough 18 to stick to the smasher 22, such as plastic or wood.

Referring to FIG. 1, the eye mask 24 is worn by the judge for the round of play and is preferably used to cover the judge's eyes so that the judge cannot see the sculpted objects 12, as described in more detail below. The eye mask 24 is preferably of a size to accommodate various sizes of heads of the players. The eye mask 24 is formed of any suitable material that can block the judge's eyesight and is of a conventional shape.

Also referring to FIG. 1, in embodiments of the present invention, the timer 26 is preferably an hourglass used to time each round of play. The hourglass includes a housing 38 for storing a plurality of grains of sand 40. The housing 38 is preferably formed of plastic or glass and is transparent so that the grains of sand 40 stored therein can be seen. The grains of sand 40 preferably are expended from a top to a bottom of the housing 38 in approximately one minute, such that each round of play is approximately one minute. However, varying-timed hourglasses could be used, such as a three-minute timer 26 or even a five-minute timer 26. In alternative embodiments of the present invention, the timer 26 could be a stopwatch (not shown), an "egg" timer (not shown), or other suitable device operable to consistently time each round of play.

Referring to FIG. 1, the plurality of points indicators 28 are plastic discs used to indicate how many points each player has accumulated throughout play of the game 10. Each points indicator 28, or disc, represents one point earned. Items other than the illustrated discs could be used to indicate the players' points, such as cards.

The game box 30 is preferably formed of cardboard, plastic, metal, or other suitable material and, as noted above, is sized to store the judge's board 14, the plurality of player's boards 16, the sculpting dough 18, the plurality of object cards 20, the smasher 22, the eye mask 24, the timer 26, and the plurality of points indicators 28. The game box 30 may include a plurality of markings 42 on an outside surface to identify the name of the game 10, a number of players, an appropriate age for the players, and other common distinguishing markings.

A method of playing the game 10 according to embodiments of the present invention will now be described. The method generally comprises the steps of: (a) setting a playing limit for each game 10, wherein the playing limit is either an amount of time the game 10 is to be played or a number of rounds of play for each game 10; (b) selecting a judge for the first round of play; (c) selecting an object to be sculpted, wherein said selection is performed by the judge for the round of play; (d) preventing the judge from visually viewing the sculpting of the objects by covering the selected judge's eyes with the eye mask 24; (e) beginning a sculpting session for the round of play by starting the timer 26 to time the sculpting session; (f) sculpting the selected object, wherein the sculpting is performed by all players of the game 10 except for the selected judge for the round of play; (g) at the completion of the sculpting session, presenting the sculpted objects 12 to the judge on the judge's board 14; (h) selecting a winning sculpted object, wherein the selection is performed by the judge based on a plurality of objective and subjective factors; (i) smashing or otherwise deforming the sculpted objects 12 except for the winning sculpted object, wherein the smashing is performed by the judge using the smasher 22; and (j) awarding the player who sculpted the winning sculpted object one of the points indicators 28.

The method of playing the game 10 generally involves multiple rounds of play. In embodiments of the present invention, preferably one to twenty rounds are played for each game 10, more preferably two to fifteen rounds are played, and most preferably three to ten rounds are played.

Additionally, the method of playing the game 10 involves the plurality of players. In embodiments of the present invention, the plurality of players preferably numbers three to twelve players, more preferably three to ten players, and most preferably three to eight players. As can be appreciated, at least three players must play the game 10 so that one player can be selected as the judge for each round of play, and two players can sculpt objects, such that the judge selects the winning sculpted object.

For step (a) of the method, the playing limit is set before beginning a first round of play. The playing limit can be chosen as either a time limit for playing the game 10, such as forty-five minutes, or a number of rounds of play for each game 10, such as ten rounds of play. The players may choose to renegotiate the playing limit during the game 10.

For step (b) of the method, the judge is selected for the first round of play. A variety of methods could be used to select the judge for the first round of play, such as choosing the youngest or oldest player, drawing the judge by random selection from each of the players (i.e., "drawing a name from a hat"), selecting a mutually agreed-upon judge, and other known methods of selection. As described in more detail below, in preferable methods of playing the game 10, the player who is the judge alternates for each round of play, such that after the first round of play, the selected judge is a winner of the previous round of play. Alternatively, the judge for each round of play could alternate amongst the plurality of players.

Step (c) of the method of embodiments of the present invention is preferably performed by the selected judge for the round of play. In embodiments of the present invention, the judge selects the object by drawing one of the object cards 20. The object labeled on the object card 20 is then the selected object to be sculpted for the round of play. As noted above, however, in embodiments of the present invention, the judge may simply select the object to be sculpted based on the judge's preference. Alternatively, prior to the first round of play, the players could agree upon a theme from which the objects could be selected, such as, for example, objects from the sea, plants, animals, objects related to a health field, objects related to a wedding, and religious objects. Regardless of how the object is chosen, in preferred methods of playing the game 10 of embodiments of the present invention, the judge provides no additional details for the object other than identification of the object itself.

Step (d) of preventing the judge from visually viewing the objects to be sculpted is performed by covering the selected judge's eyes with the eye mask 24. In this manner, the judge cannot see which player sculpted a particular sculpted object 12. In alternative embodiments of the present invention, the judge could also select the winning sculpted object without use of his/her eyesight and by tactile feel alone, such that the judge continues to wear the eye mask during the selection of the winning sculpted object. Such a method would thus include the step of feeling each of the presented sculpted objects 12, wherein the feeling is performed by the judge using the judge's hands or other preferred form of tactile feel.

Each round of play includes the sculpting session, which is the period of time during which all the players except for the judge sculpt the object selected in Step (c). Step (e) is performed by first starting the timer 26. If the timer 26 is an hourglass, the hourglass is turned over so that the plurality of grains of sand 40 can begin to drain from the top to the bottom of the hourglass housing 38. If the timer 26 is another mechanism, such as the stopwatch or the "egg" timer 26, the timer 26 is turned to the desired number of minute(s) for the sculpting session.

Step (f) of the method of embodiments of the present invention comprises sculpting the selected object. The sculpting is performed during the sculpting session by each of the players except for the judge for the round of play. Each player is provided one of the player's boards 16 for sculpting of the player's sculpted object 12 thereon. The players preferably user their hands to sculpt the objects. However, in embodiments of the present invention, the game 10 may be provided with sculpting tools (not shown), such as a wire loop, a spatula, and/or a smoother to assist in sculpting the object.

As noted above, how the player sculpts the object, and how the winning sculpted object is selected by the judge, may be dependent on a variety of subjective and objective factors. For example, in some instances, the judge may inform the players prior to beginning the sculpting session that the winning sculpted object will be the sculpted object that most literally represents the selected object. Alternatively, the judge may inform the players that the winning sculpted object will not be based on a literal interpretation of the object and instead, on a fanciful interpretation of the object. In even further instances, the judge may select the object that is the stereotypical form of the object, as based on the judge's subjective interpretation. For example, if the selected object is a telephone, the shape of the object could either be a traditional telephone having a base, a hand-held transceiver unit, and a cord connecting the base and the unit. Alternatively, a telephone shape could be that of a mobile telephone. If the judge provides no details on the selected object other than identifying the selected object by name, each player must choose how the player will sculpt the object based on the player's subjective and objective understanding of the object and the judge's preferences, i.e., a traditional telephone shape or a mobile telephone shape.

At the completion of the sculpting session, each player places the player's sculpted object 12 on the judge's board 14, which is preferably positioned in front of the judge and within reach of the judge. The sculpted objects 12 are then presented to the judge, as set forth in Step (g). Preferably, the sculpted objects 12 are presented on the judge's board 14 so that the judge cannot determine which player sculpted each particular sculpted object 12 based on location of placement on the judge's board 14.

After the sculpted objects 12 are presented to the judge, the judge selects the winning sculpted object and informs the players of the winning object, as set forth in Step (h). As noted above, the judge may use any factor or criteria for choosing the winning sculpted object. In alternative forms of playing the game 10, the judge is not required to inform the players of the judge's factors or criteria for choosing the winning sculpted object.

If the alternative method of playing the game 10 is employed wherein the judge wears the eye mask 24 during the selection of the winning sculpted object, then the judge begins feeling each presented sculpted object 12 with his/her hands to determine the winning sculpted object. At this time, the judge is still wearing the eye mask 24 so that the judge cannot select the winning sculpted object using the judge's eyesight. The judge could use alternative forms of feeling the sculpted objects 12, such as the judge's toes or tongue or via a hand-held tool, but in preferable forms of the alternative method of embodiments of the present invention, the judge's hands are used. Additionally, the judge may be provided a limited time to perform the step of feeling each presented sculpted object 12. Such limited time could also be measured using the timer 26 for measuring the time for the sculpting session.

After the judge has selected the winning sculpted object, the judge smashes or otherwise deforms the remaining sculpted objects 12 using the smasher 22, as set forth in Step (i). In alternative embodiments of the present invention where the judge performs the selection process of Step (h) while wearing the eye mask 24, the judge may, prior to smashing the remaining sculpted objects 12, remove the eye mask 24 so that the judge can see all the sculpted objects 12. This is advantageous because the players of the game 10, including the judge, may comment on the judge's choice, which is entertaining and insightful as to why the judge chose the winning sculpted object over the remaining sculpted objects 12. In even further alternative embodiments of the present invention, the judge smashes the remaining sculpted objects 12 while still wearing the eye mask 24. This method is also advantageous, as it could be entertaining for the players to watch the judge smash the remaining sculpted objects 12 without use of the judge's eyesight.

In even further alternatives of the method of embodiments of the present invention, the order of Steps (h) and (i) may be comingled, such that the judge feels one of the sculpted objects 12 and decides, at that time and before feeling the next sculpted object 12, whether the judge believes the object should be the winning sculpted object (and therefore, not smashed). The judge may thus be given only one opportunity to feel each sculpted object 12, such that should the judge come across what he/she believes to be a possible winning sculpted object, the judge decides not to smash the object and to instead feel the next sculpted object 12. Upon the judge feeling the last sculpted object 12, the judge must then decide whether to smash the last sculpted object 12 or the possible winning sculpted object previously left intact and without being given the opportunity to repeat feeling the possible winning sculpted object. Alternatively, the judge could be allowed to repeat feeling of the sculpted objects 12, depending on a preference of the players.

After the judge has chosen the winning sculpted object, the player who sculpted the winning object is awarded one of the points indicators 28, as set forth in Step (j). Each points indicator 28 represents one point. At the end of the game 10, the player with the most points indicators 28, i.e., the most points, is the winner of the game 10. Alternatively, the game 10 could be played such that the first player to five points, for example, is the winner of the game 10.

Although the invention has been described with reference to the preferred embodiment(s) illustrated in the attached drawing figures, it is noted that equivalents may be employed and substitutions made herein without departing from the scope of the invention as recited in the claims. Such equivalents, substitutions, and alternatives have been described throughout.

Having thus described embodiments of the present invention, what is claimed as new and desired to be protected by Letters Patent includes the following:

1. A method of playing a game for sculpting objects performed by a plurality of players, the method comprising the steps of:

(a) setting a playing limit for each game, whereupon expiration of the playing limit, the game is completed;

(b) having the players select a judge for a round of play of the game;

(c) having the judge select an object to be sculpted;

(d) having the players or the judge prevent the judge from visually viewing the objects to be sculpted by covering the selected judge's eyes with an eye mask;

(e) having at least one of the players begin a sculpting session for the round of play by starting a timer to time the sculpting session;

(f) having the non-judge players sculpt the selected object using sculpting dough;

(g) at the completion of the sculpting session, having the non-judge players each present their respective sculpted objects to the judge, wherein the judge continues to be prevented from visually seeing the sculpted objects;

(h) having the judge select a winning sculpted object, wherein the judge is not prevented from visually seeing the sculpted object while selecting the winning sculpted object;

(i) having the judge deform the sculpted objects except for the winning sculpted object with a deforming tool shaped like a gavel or a mallet; and (j) awarding the non-judge player who sculpted the winning sculpted object at least one point.

2. The method of claim 1, wherein Step (g) is performed using a judge's board.

3. The method of claim 1, wherein the selection of the winning sculpted object in Step (h) is performed by the judge based on the judge's opinion or preference of which sculpted object the judge likes the best or that the judge believes best meets a one or more predetermined criteria.

* * * * *